US005548854A

United States Patent [19]

Bloemer et al.

[11] Patent Number: 5,548,854

[45] Date of Patent: Aug. 27, 1996

[54] HYDRO-MASSAGE TUB CONTROL SYSTEM

[75] Inventors: John M. Bloemer, Madison; Isadore Balan, Mequon; Thomas A. Bonnell, Sheboygan; Alan D. Bengtson, Milwaukee; Robert C. Giose; Mary J. Reid, both of Sheboygan; John A. Fiumefreddo, Plymouth; Michael J. Kurth, Fond du Lac, all of Wis.

[73] Assignee: Kohler Co., Kohler, Wis.

[21] Appl. No.: 107,404

[22] Filed: Aug. 16, 1993

[51] Int. Cl.[6] ..... A61H 33/02

[52] U.S. Cl. ..... 4/541.6

[58] Field of Search ..... 4/541.1–541.6; 601/160, 169

[56] References Cited

U.S. PATENT DOCUMENTS

| | | | |
|---|---|---|---|
| 3,374,492 | 3/1968 | Ruderian . | |
| 4,139,001 | 2/1979 | Macabee | 128/64 |
| 4,237,562 | 12/1980 | DuPont . | |
| 4,339,833 | 7/1982 | Mandell . | |
| 4,466,141 | 8/1984 | Starkey . | |
| 4,630,599 | 12/1986 | Perovick et al. | 4/541.3 |
| 4,716,605 | 1/1988 | Shepherd et al. | 4/541.3 X |
| 4,742,456 | 5/1988 | Kamena | 4/541.2 X |
| 4,797,958 | 1/1989 | Guzzini . | |
| 4,839,930 | 6/1989 | Watkins . | |
| 4,903,352 | 2/1990 | Murakami | 4/541 |
| 4,908,888 | 3/1990 | Watkins . | |
| 5,010,605 | 4/1991 | Shiina et al. . | |
| 5,079,784 | 1/1992 | Rist et al. . | |
| 5,143,121 | 9/1992 | Steinhardt et al. | 137/624.13 |
| 5,245,714 | 9/1993 | Haraga et al. | 4/541.6 X |
| 5,333,324 | 8/1994 | Pinciaro | 4/541.1 X |

*Primary Examiner*—Charles E. Phillips
*Attorney, Agent, or Firm*—Quarles & Brady

[57] ABSTRACT

A whirlpool tub has a first set of nozzles located to direct water against the back of a bather and a second set of nozzles to direct water against the bather's neck. A controller has different modes of operation in which water is emitted by either one or both sets of nozzles. Separate mechanisms are provided to direct a pulse of water sequentially through different nozzles in each set. This action produces a progression of pulsating water jets that create a massaging effect on the bather's skin. A pillow is placed about the second set of nozzles. A sensor is provided to detect when the pillow is removed and disable water flow through the second set of nozzles.

21 Claims, 5 Drawing Sheets

FIG. 1
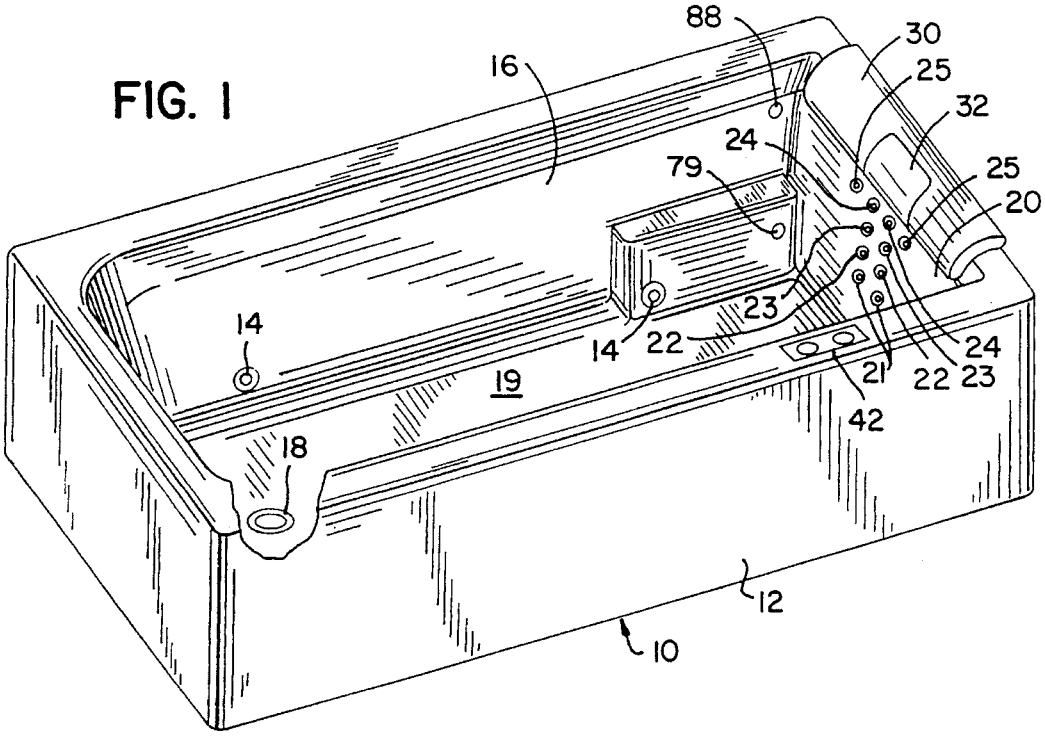
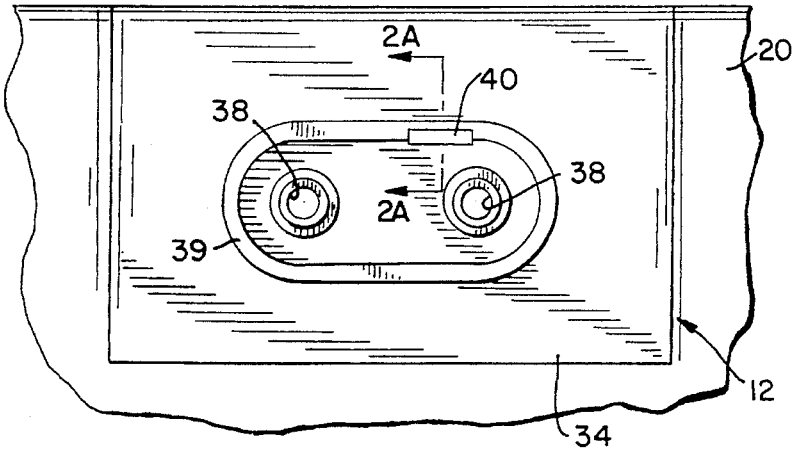
FIG. 2
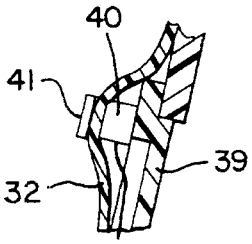
FIG. 2a

HYDRO-MASSAGE TUB CONTROL SYSTEM

BACKGROUND OF THE INVENTION

The present invention relates to a hydro-massage spas and whirlpools; and more particularly to control systems for regulating water flow in such spas or whirlpools.

Hydro-massage spas and whirlpools provide a therapeutic massaging action by delivering water through several nozzles in a tub wall to create a circulating flow of turbulent water. The tub water is drawn through a drain to a pump and then outward through the nozzles to create jets of water in the tub. Air can be added to the circulating water at a controlled rate at each nozzle to increase the turbulence and massaging action of the water exiting from the nozzles. Often each nozzle can be pivoted to direct its jet of water toward a desired area of the bather's body. Some nozzles even allow adjustment of the amount of water flow or the amount of air that is mixed with the water.

Although the circulating water from such whirlpool or spa provides a massaging effect, the water flow does not replicate the rhythmic manipulation of tissue performed by a massage therapist. That manipulation involves a sequential stimulation of skin tissue in different areas of the body. For example, the massage may include a progressive rubbing along the spine. Such manipulation is particularly soothing to the back and neck of an individual.

SUMMARY OF THE INVENTION

A general object of the present invention is to provide a whirlpool tub that simulates the therapeutic rhythmic body manipulation of a massage.

Another object is to provide a mechanism that sends pulsating water progressively through a series of nozzles to create a rhythmic stimulation of the skin of a bather.

These objects are satisfied by a hydro-massage apparatus which includes a tub with wall and a drain opening. A pump has an inlet connected to the drain opening. Water is feed from the pump to a pulser mechanism that send pulses of water sequentially through a series of outlets. A plurality nozzles is located in the wall of the tub to direct a flow of water into the tub. For example, these nozzles are located to direct jets of water against different regions of the bather's back. At least one nozzle is connected to each outlet of the pulser mechanism. Thus the plurality of nozzles sequentially emit pulses of water that create a rhythmic therapeutic massaging effect upon striking the bather.

In the preferred embodiment, a second plurality of nozzles is provided to direct water against the bather's neck. A separate pulser mechanism sequentially pulsates the water flow through the second plurality of nozzles and create a similar rhythmic therapeutic massaging effect.

A further object of the present invention is to provide a controller that enables each plurality of nozzles to be individually activated and to separately regulate the water flow pulse rate from each pulser mechanism.

BRIEF DESCRIPTION OF THE DRAWINGS

FIG. 1 is an isometric view of a whirlpool tub that incorporates the present invention;

FIG. 2 is a plane view of a pair of nozzles for the neck pillow in FIG. 1;

FIG. 2A is a cross-sectional view along line 2A–2A in FIG. 1;

DETAILED DESCRIPTION OF THE INVENTION

Figure 3:
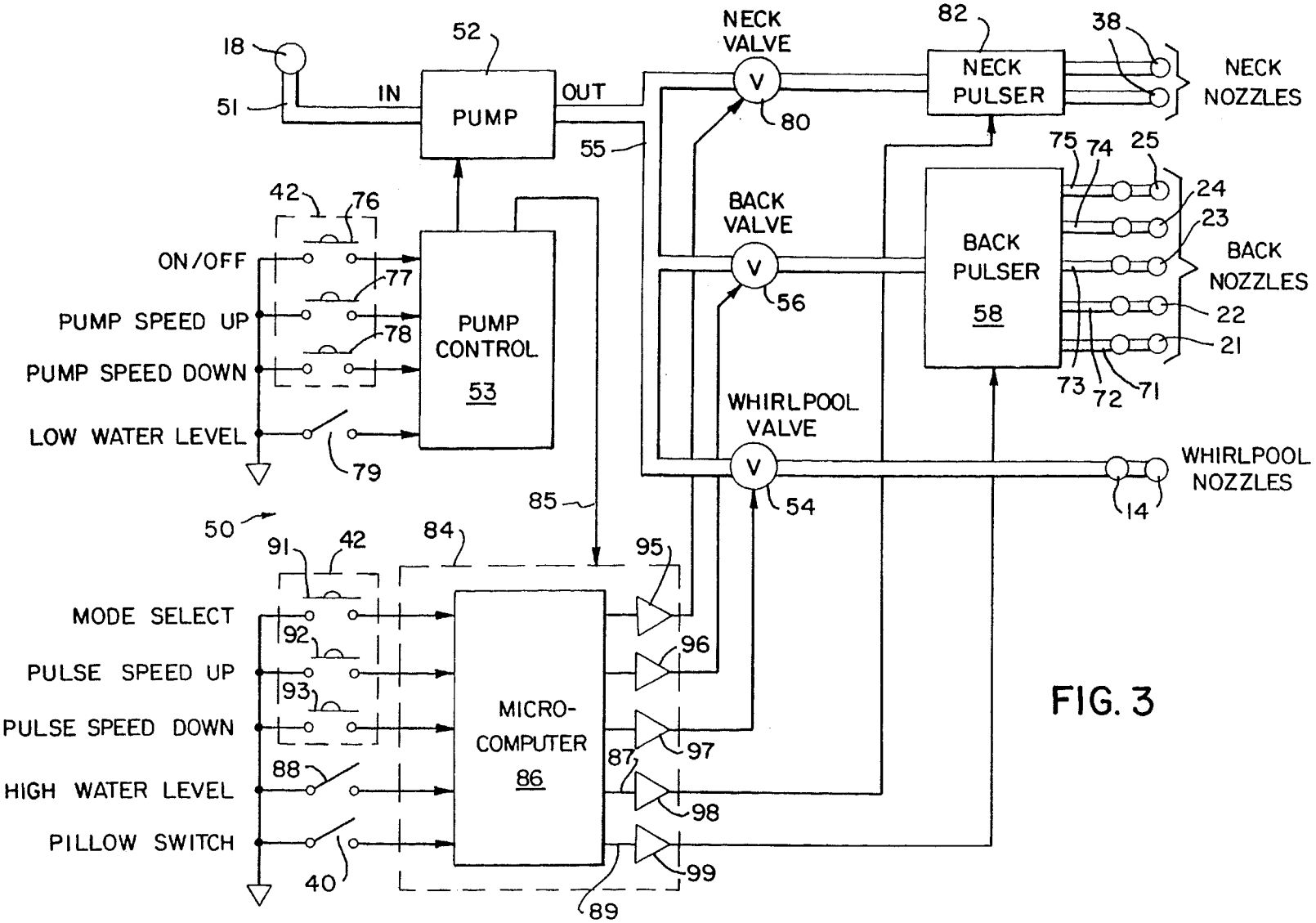
FIG. 3 is a schematic block diagram of the control circuit of the whirlpool tub.

With reference to FIG. 1, a hydro-massage whirlpool 10 includes a tub 12 having a plurality of conventional whirlpool nozzles 14 projecting through an interior side wall 16. Another pair of conventional nozzles may be located on the opposite side wall. The tub floor 19 has a standard drain opening 18. One end of the tub has an end wall 20 with a plurality of nozzles 21, 22, 23, 24 and 25 that are arranged in pairs. Four of the pairs 21, 22, 23 and 24 are arranged above one another with the fifth pair of nozzles 25 located horizontally on either side of the fourth pair of nozzles 24, thus forming a T-shaped pattern. As will be described, each pair of nozzles 21–25 is connected to a separate supply line to receive water independently the supply to the other pairs of nozzles.

A soft cushion 30 is attached to the rim of the tub at the one end 20. The cushion 30 may be formed of a outer covering of a vinyl material with a soft filler material inside. The cushion 30 has a central cut out section in which a separate removable pillow 32 is located. The pillow 32 has a U-shaped inner pad of resilient material which conforms to the bather's neck. The pad is covered by a porous fabric membrane to form a rectangular shaped pillow that permits streams of water to pass therethrough. The neck of a person in the tub rests within the central opening of the pillow's inner pad with the person's head supported by the pad.

The pillow fits into a depression 34 in the end wall 20 of the tub 12, illustrated in FIG. 2. A pair of neck nozzles 38 are mounted on an assembly 39 within the depression 34 and create water jets which pass through the fabric membrane of the pillow and strike the bather's neck. The pillow 32 has a bracket (not shown) on its underside which engages the neck nozzle assembly 39 to hold the pillow in place. A reed switch 40 is attached to the neck nozzle assembly 39 and is closed by a magnet 41 attached to the pillow 32, as shown in FIG. 2A. Closure of the reed switch 40 provides a signal to a whirlpool control system that indicates when the pillow 32 is in place.

Referring again to FIG. 1, a control panel 42 with a number of push button switches is mounted on the rim of tub 12 and is used by the bather to select the mode of operation of the whirlpool 10. In a basic mode, water jets are produced from the conventional whirlpool nozzles 14 in the side walls to create a turbulent flow of water throughout the entire tub.

In another mode of operation, the pillow nozzles 38 emit a pulsating flow of water to massage the bather's neck while water jets continue to be produced by whirlpool nozzles 14. Water alternately pulsates through the two neck nozzles 38 and penetrates the pillow to stimulate the cervical area on each side of the bather's neck.

In a back massaging mode, water is supplied to the set of back nozzles 21–25 and the flow through the whirlpool nozzles 14 is terminated. The water is sequentially fed to each pair of back nozzles 21, 22, 23, 24 and 25 to create a progressive stimulation of the bather's back at different points where the water jets strike. That is water is first pulsed through nozzle pair 21, then nozzle pair 22, and so on until the cycle terminates with a pulsation of water through back nozzles 25. The pulsation cycle then repeats over and over again. Alternatively, the pulsation of each pair of nozzles 21–25 can be reversed to go progressively downward along the bather's back. This sequential pulsation of water through the back nozzles 21–25 simulates a massage of the thoracic and lumbar spine areas providing the bather with the soothing and tension relieving effects of a professional massage.

In a final operating mode, water pulsates through both the back and neck nozzles 21–25 and 38 to stimulate the thoracic and lumbar spine areas as well as the cervical region of the bather.

FIG. 3 illustrates the control system 50 for producing these different modes of operation. The plumbing for the whirlpool 10 comprises a connection 51 between the drain 18 and the inlet of a pump 52 that is driven by a variable speed motor. An outlet of the pump 52 is connected by tube 55 to an electrically operated whirlpool valve 54 which controls the flow of water to the whirlpool nozzles 14.

The pump 52 is operated by a conventional pump control 53 that responds to push button switches on control panel 42. A first push button switch 76 turns on and off the pump and two other push button switches 77 and 78 cause the pump speed to increase or decrease, respectively. The pump control 53 also responds to a low water level sensor 79 which is located in a lower section of the tub side wall 16. This sensor 79 has an electrical switch which closes when the water level is at least as high as the location of the sensor. Unless the low water level sensor 79 indicates this level of water, the pump control 53 will not activate the pump 52 thereby preventing the pump from operating when there is insufficient water in the tub 12.

The output of the pump 52 also is connected by a back valve 56 to the input of a back pulser 58. The back pulser sequentially distributes water from the pump to the pairs of back nozzles 21–25 thereby progressively sending water pulses through each pair of nozzles.

Figure 4A:
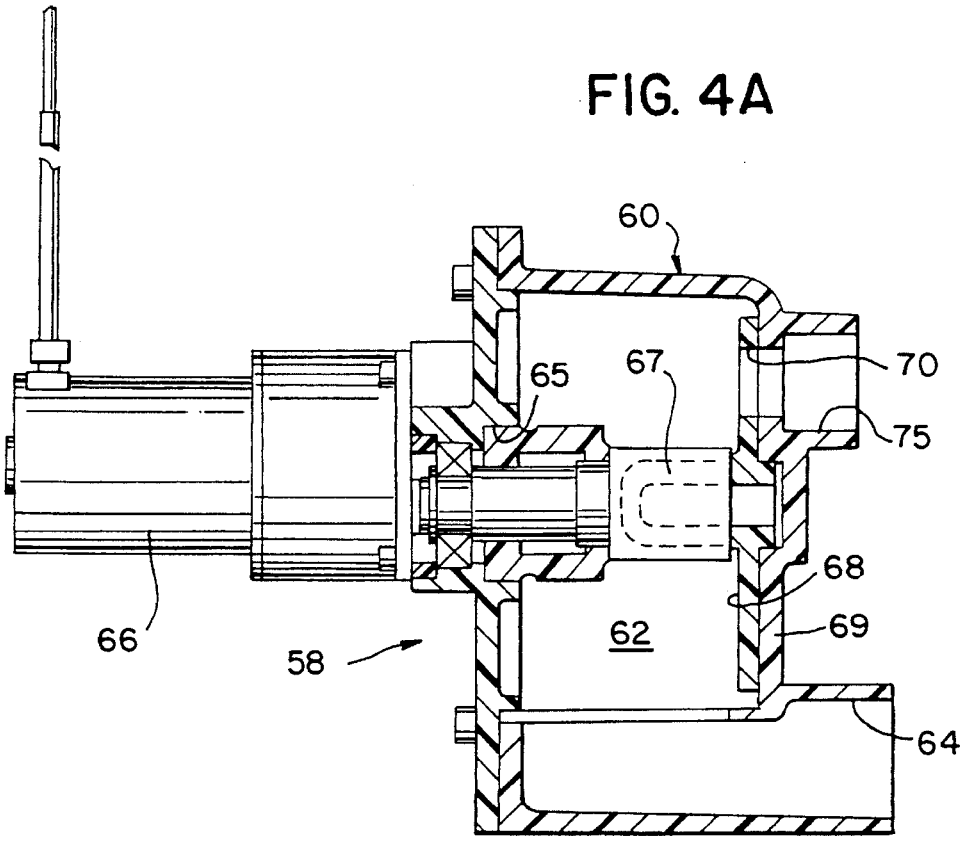
FIGS. 4A and 4B depict the back pulser mechanism which sequentially distributes water to different sets of the back nozzles in the whirlpool tub.
Figure 4B:
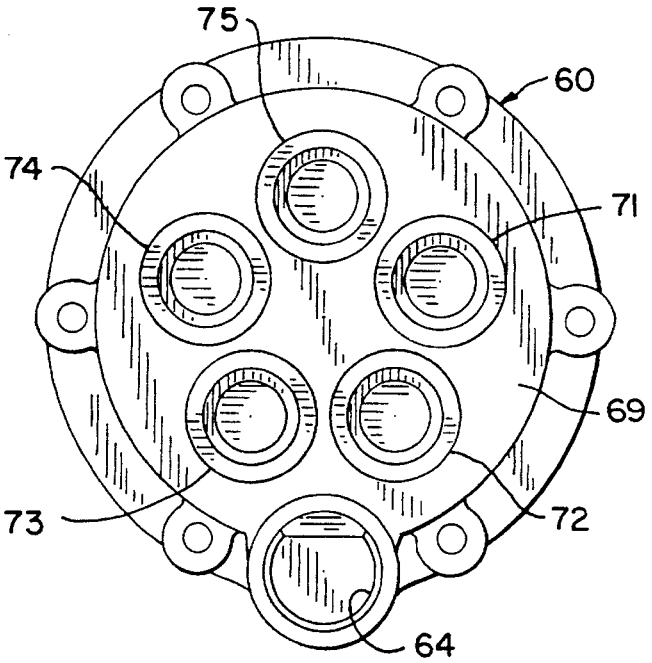

The details of the back pulser 58 are shown in FIGS. 4A and 4B. The back pulser 58 has a housing 60 forming a water flow chamber 62 and an inlet 64 to which tube 55 from the pump 52 attaches to supply water to the chamber 62. The housing has an end wall 69 through which extend five outlets 71, 72, 73, 74 and 75. A DC electric motor 66 is attached to the housing 60 and has a shaft 67 that extends through a sealed opening 65 into the chamber 62. A valve plate 68 is located within the housing against wall 69 and is mounted on the remote end of the motor shaft 67.

When the DC motor 66 is energized, shaft 67 rotates the valve plate 68 against the end wall 69. This action causes an aperture 70 in the valve plate 68 to sequentially pass over each of the outlets 71–75 allowing water to flow from the chamber 62 through the outlets. As the aperture 70 moves from one outlet 71–75 to the next, a solid portion of valve plate 68 covers the formerly open outlet shutting off the flow of water therethrough. Thus, the rotation of disk 68 sequentially opens and closes each of the outlets 71–75 thereby pulsating the flow of water through each outlet. The aperture 70 is an elongated arcuate opening in the valve plate 68 which has a length that as the disk 68 rotates the next outlet 71–75 begins to be opened before the previously opened outlet fully closes. During the rotation of valve plate 68 there is never a time at which all of the outlets 71–75 are closed and water hammering caused by rapid water shut-off does not occur.

Referring again to FIG. 3, back pulser outlets 71–75 are connected to different pairs of back nozzles 21–25, respectively. Therefore, as the valve plate 68 sequentially opens each of the outlets, water is progressively applied to each one of the back nozzles 21–25.

The output of the pump 52 also is connected to a solenoid operated neck valve 80 which controls the flow of water to a neck pulser 82. This neck pulser is similar to the back pulser 58 except that the neck pulser 82 has only two outlets that are coupled to different ones of the neck nozzles 38. Therefore, when the neck pulser 82 is energized, water is alternately pulsed through the two neck outlets 38.

Alternatively, the motor driven pulsers 58 and 82 could be replaced by separate solenoid valves in the supply lines for the back nozzles 21–25 and in the supply line for the neck nozzles 38. In this case, the solenoid valves would be opened briefly in rapid progression to sequentially send a pulse of water through the associated nozzle or nozzles. If separate solenoid valves are used the common back and neck valves 56 and 80 can be eliminated as the flow of water can be terminated by closing the appropriate group of the individual valves.

The solenoid valves 54, 56 and 80 and the two pulsers 58 and 82 are controlled by a jet control circuit 84, which receives electrical power via line 85 from the pump control whenever the pump is operating. The jet control circuit 84 contains a microcomputer 86 which includes a microprocessor, a read only memory, a random access memory and associated circuit components. The microcomputer 86 executes a control program, stored in the read only memory, which governs the operation of the control system 50. The control program will be described in detail subsequently.

The control panel 42 includes three switches 91, 92 and 93 that are connected to inputs of the microcomputer 86 to control the operation of the neck and back nozzles. The first push button switch in this set is a mode select switch 91 which is used to step the jet control 84 from one operational mode to the next. The other two push button switches 92 and 93 are used to respectively increase and decrease the speed of the back and neck pulsers 58 and 82.

Another input of the microcomputer 86 is connected to a high water level sensor 88. This sensor is mounted higher on the tub wall 16 than the low water level sensor 79 and produces an input signal when the water reaches that higher level. The high water level sensor 88 provides an indication when water in the tub 12 has reached a satisfactory level so that the back nozzles 21–25 can be operated without spraying water out of the tub. The pillow reed switch 40 is connected to yet another input of the microcomputer 86.

The microcomputer 86 includes a number of outputs at which signals are produced to control the valves and pulsers. Three of these outputs are connected by separate valve drivers 95, 96 and 97 to the solenoid coils of the neck valve 80, the back valve 56 and the whirlpool valve 54, respectively. The microcomputer 86 has two analog outputs 87 and 89 which are used to control the speed of the DC motors in the back and neck pulsers 58 and 82. Specifically, the first analog output 87 is connected by a driver 98 to the DC motor of the neck pulser 82 and the other analog output 89 is connected by driver 99 to the DC motor 66 of the back pulser 58. As will be described, the microcomputer changes the voltage level at each of the analog outputs 87 and 89 to vary the speed of the respective DC motor and thus the rate of water pulsation.

The bather commences operation of the whirlpool 10 by pressing the on/off push button 76 connected to the standard pump control 53. This action causes the pump control to energize pump 52 at approximately fifty percent of its full speed, as long as the low water level sensor 79 indicates that there is sufficient water in the tub 12. By pressing either push button 77 or 78, the bather is able to increase or decrease the pump speed.

When the pump 52 is turned on, electrical power also is applied via line 85 to the jet control 84. This causes the microcomputer 86 in the jet control to begin executing the stored control program and depicted by the flowchart in FIG. 5A. The program commences at step 100 by setting the different variables used in the program execution to their initial values. Then at step 102 the microcomputer 86 opens the whirlpool valve 54 so that the output of the pump 52 will flow through whirlpool nozzles 14. Thus, the whirlpool 10 begins in a conventional state of operation.

From that conventional state, the bather is able to select several massage modes utilizing the push buttons 91–93 connected to the jet control 84. The control program executed by the microcomputer 86 responds to the activation of the switches 91–93 by operating the different valves and water pulser. The bather activates mode select switch 91 to change the mode of operation. The mode select switch activation is detected at step 103 from which the program execution advances to step 104 where a variable designated MODE is incremented to indicate the mode of operation being selected by the bather.

Then at step 105 the program execution branches to the appropriate section of the control program for the selected mode. The first mode (MODE=1) is neck massage only operation. This mode begins at step 106 where a determination is made whether the pillow 32 is in place. As noted previously, the pillow 32 has a magnet 41 attached to its underside which closes reed switch 40 and thus signals the microcomputer 86 that the pillow is present. If the signal from reed switch 40 indicates that the pillow is absent, the program execution jumps to step 139 bypassing the neck massage operation.

However, when the pillow is in place, the microcomputer 86 produces an output signal that causes driver 95 to open the neck valve 80 at step 108. This couples the output of the pump 52 to the neck pulser 82 supplying water to the neck nozzles 38. Then at step 110 the microcomputer 86 produces an signal at output 87 which via driver 98 energizes the motor of the neck pulser 82 to apply pulses of water alternately through the two neck nozzles 38. When the neck pulser 82 is initially turned on, the level of the analog signal at microcomputer output 87 causes the neck pulser motor to operate at about fifty percent of its full speed. The speed of the neck pulser 58 is determined by the value of a variable stored in the random access memory of microcomputer 56. This variable was initialized at step 100 to its mid point value. As will be described, the bather then is able to change the value of this variable and thereby vary the pulsation rate of the neck pulser 82. In the first mode, water pulses are sent alternately through the neck nozzles 38 to massage the back of the bather's neck resting on pillow 32, while water still flows through whirlpool nozzle 14.

When the bather presses the mode select switch 91 again, the control program enters the second mode (MODE=2) in which only the back massage nozzles 21–25 are active. In the second mode, the program execution branches from step 105 to step 112 where the microcomputer 86 senses the input from the high water level sensor 88. If the water has not reached the level of that sensor, the program jumps to step 139 bypassing the commencement of the back massage mode.

If at step 112, the water is at the proper level, the program branches to open the back valve 56 at step 120 and energize the back pulser 58 at step 122. When the back pulser 58 is initially turned on during a given use of the whirlpool 10, the microcomputer 86 produces an signal at output 89 which causes the motor in the back pulser to operate at approximately fifty percent of its full speed. The speed of the back pulser 82 is set by another variable stored in the random access memory of microcomputer 86 which variable is initially set at its mid point value at step 100. As will be described, the bather then is able to change the value of this variable and thus adjust the back pulser speed.

When the back pulser is activated, water begins to flow through the back nozzles 21–25 with the water flow being sequentially directed through each of those nozzles by the back pulser 58. At this time, the microcomputer deactivates its appropriate output lines to close the neck and whirlpool valves 80 and 54 respectively at step 124. Thus, water does not flow through the conventional whirlpool jets 14 in the back massage only mode (MODE =2).

If during the second mode of operation the bather again presses the mode select switch 91, whirlpool operation enters the third mode (MODE=3) at step 126. At this point, the high water level sensor 88 is checked by the microcomputer 86 to insure that the water in the tub 12 is at the proper level for back nozzle operation. If the water level is not high enough, commencement of this mode is bypassed by jumping to step 139. Otherwise both the back and the neck valves 56 and 80 are opened by appropriate output signals from the microcomputer 86 at step 128. Then at step 130 the microcomputer produces active signals at its outputs 87 and 89 to turn on the back and neck pulsers 58 and 82. The magnitudes of the output signals are determined by the separate pulser speed variables stored in the random access memory of microcomputer 86.

Further activation of the mode select switch 91 causes the operation of the jet control 48 to enter the off mode (MODE=4). Here the program execution advances from step 105 to step 132 where the whirlpool valve 54 is opened by the appropriate output signal from the microcomputer 86. This action begins restoration to conventional whirlpool operation where water flows through whirlpool nozzles 14. Then at step 134 the microcomputer deactivates the appropriate outputs to close the back and neck valves 56 and 80. Next at step 136, the back and neck pulser 58 and 82 are turned off by the microcomputer producing zero volts at outputs 87 and 89. Thereafter the value of the MODE variable is set to zero at step 138 to indicate the conventional whirlpool mode.

Figure 5A:
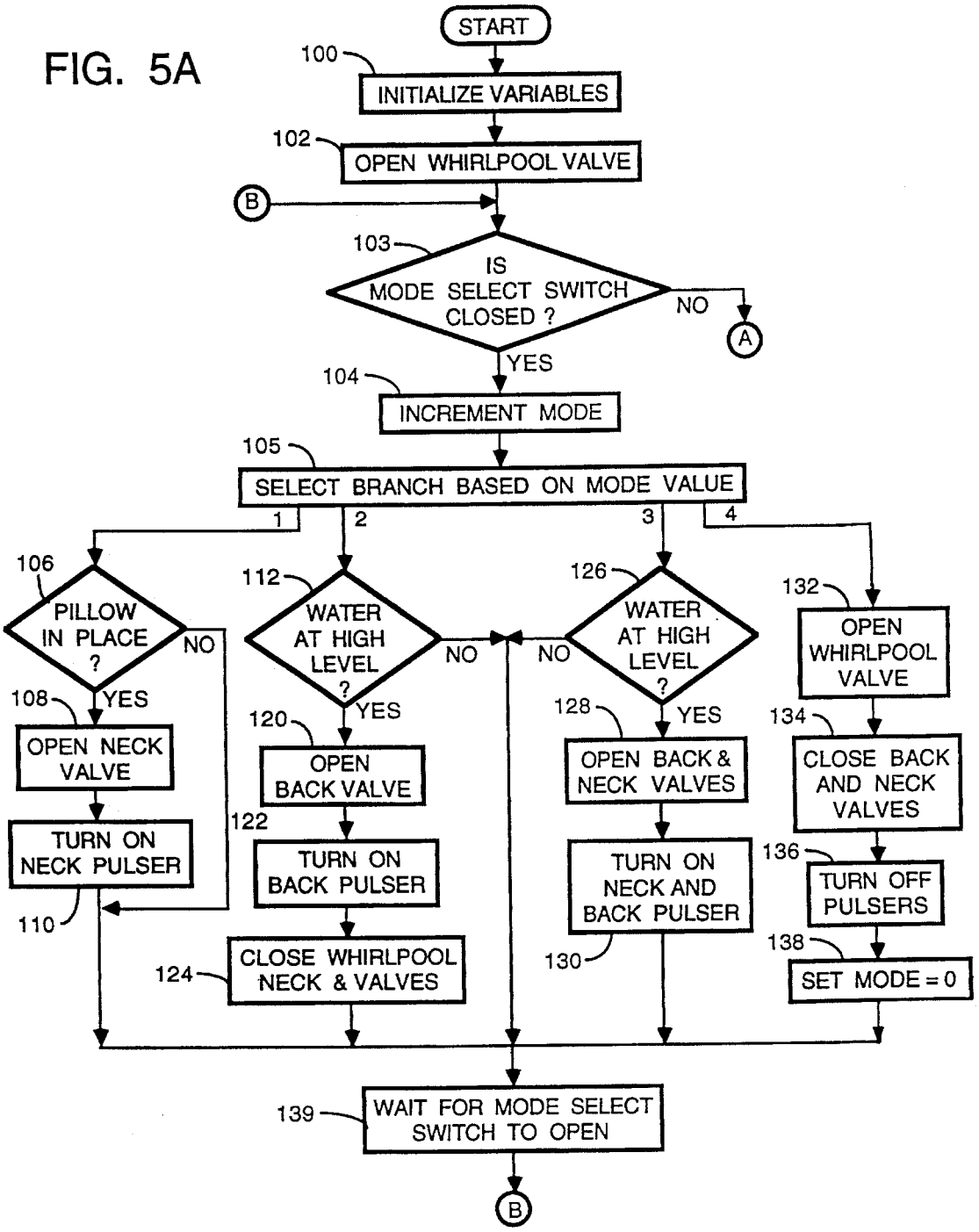
FIGS. 5A and 5B forms a flowchart of the operation of the jet control in FIG. 3.

At the end of each program branch for the different operating modes in FIG. 5A, the program execution advances to step 139 where the microcomputer 86 monitors its input line connected to the mode select switch 91. The microcomputer waits at this step until the mode select switch is released by the bather, thereby preventing continuously looping through the mode selection steps while the bather continues to depress the mode select switch 91. Once this switch 91 has been released the program execution returns to step 103.

Figure 5B:
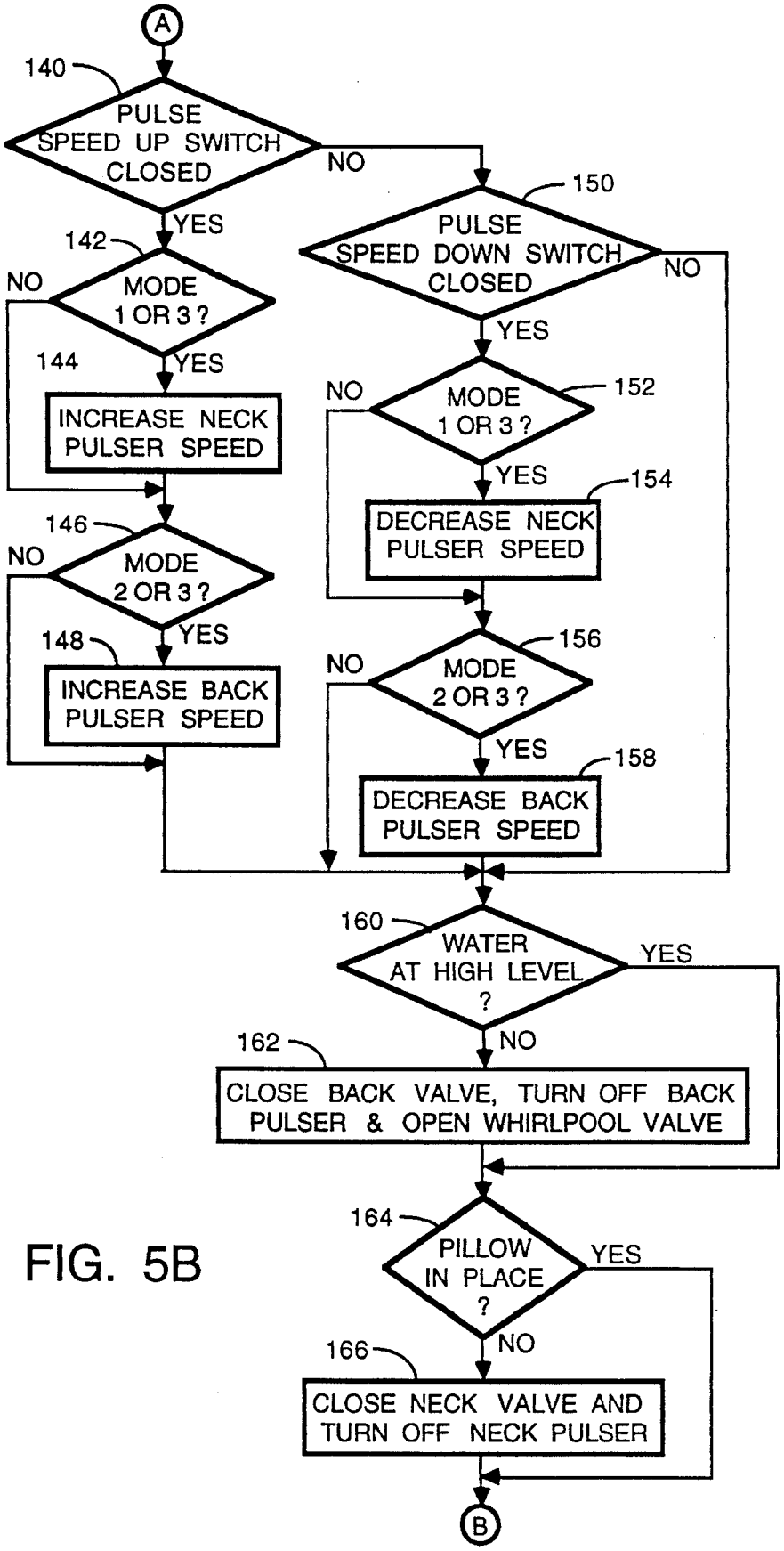

If at step 103 the mode select switch 91 is found to be open, the program execution branches to step 140 on FIG. 5B. Here the microcomputer 86 checks the input line connected to the pulse speed up switch 92. If this switch is being depressed by the bather, a determination is made at step 142 whether the whirlpool 10 is operating in either the neck mode or the back and neck mode (MODE=1 or 3). If such is the case, the variable indicating the neck pulser speed is incremented at step 144. Incrementing that variable produces an increase in the signal level at output 87 thereby increasing the water pulsation rate of neck pulser 82.

Next at step 146, a determination is made whether the whirlpool 10 is operating in either the back massage only mode or the neck and back massage mode (MODE=2 or 3). If so, the program execution advances to step 148 where the value of the back pulser speed variable is incremented and the signal at microcomputer output 89 is increased to produce a corresponding increase in the water pulsation rate of the back pulser 58. The speed of both the neck pulser 82 and the back pulser 58 are indicated by separate variables in the microcomputer memory so that as the bather steps through each of the modes of operation, the pulsers 58 and 82 will be activated at their previously set speed. After execution of step 149 the program advances to step 160.

If at step 140 the pulse speed up switch was not closed, the program execution branches to step 150 where the input to the microcomputer 86 which is attached to the pulse speed down push button switch 93 is checked. If the bather is depressing this switch thus indicating a desire that the speed of the active pulser should be decreased, the program execution advances to step 152 where a determination is made whether the whirlpool is operating in either the neck mode or the neck and back mode (MODE=1 or 3). If so, the neck pulser speed is decreased at step 154 by altering voltage at output 87 and decrementing the neck speed variable in the microcomputer memory. Then at step 156 a determination is made whether the whirlpool control system 50 is operating in either the back only mode or the neck and back mode (MODE=2 or 3). In either of these modes, the speed of the back pulser 58 is decreased in a similar manner. Then the program execution advances to step 160.

At step 160, the microcomputer 86 checks the high water level sensor switch 88. If for some reason the water level has dropped below this sensor and no longer is high enough for proper operation of the back water nozzles 21–25, the microcomputer 86 at step 162 closes the back valve 56 and turns off the back pulser 58 to terminate a back massage until the water level once again reaches a satisfactory height. The whirlpool valve 54 also is opened to ensure that water can flow from the pump through at least one set of nozzles.

Then at step 164 the microcomputer input from the reed switch 40 is checked to ensure that the pillow 32 still is in place. If the pillow has been removed the neck valve 80 is closed and the neck pulser 82 is turned off at step 166. Thereafter, the program returns to step 103.

The control system 50 sequentially applies pulses of water through each pair of back nozzles to produce jets of water in the tub 12 the progressively stimulate the thoracic and lumbar spine areas of the bather. This action replicate a therapeutic massage as given by a massage therapist. Independently of in conjunction with the back massage, pulsating water can be directed at alternate sides of the bather's neck to massage the cervical area. The rates at which the water jets for the areas are pulsed can be controlled separately. In addition, the control system has automatic safeguards that prevent water from flowing through the neck nozzles when the pillow covering has been removed and through the back nozzles if the water in the tub is of insufficient height.

We claim:

1. A hydro-massage apparatus comprising:

a tub having a wall on one side of the tub and a drain opening;

a first plurality nozzles located in the wall of said tub to direct a flow of water into the tub, said first plurality of nozzles comprise first, second, third, fourth and fifth pairs of nozzles, the first, second, third and fourth pairs of nozzles being arranged vertically with respect to each other in the wall with the fifth air of nozzles arranged substantially horizontally between the fourth pair of nozzles;

a pump with an inlet connected to the drain opening; and a first pulser mechanism coupled to receive water from said pump and having a plurality of outlets connected to said first plurality of nozzles with each outlet being connected to a different pair of the first, second, third, fourth and fifth pairs of nozzles, said first pulser mechanism directing a pulse of water sequentially through each outlet to produce a jet of water sequentially at different ones of said first plurality nozzles and thereby creating a pulsating pattern of water flow that has a massaging effect in the tub.

2. The hydro-massage apparatus as recited in claim 1 wherein said first pulser mechanism comprises:

a housing having a chamber, an inlet communicating with the chamber and connected to said pump, and a outlet wall through which the plurality of outlets extend;

a valve plate within the chamber and abutting the outlet wall, and having an opening therethrough so that when said valve plate is rotated the opening sequentially opens and closes each of the plurality of outlets to a flow of water; and a device for rotating said valve plate.

3. The hydro-massage apparatus as recited in claim 1 further comprising a controller connected to said first pulser mechanism to vary a rate at which pulses of water are sequentially directed through each outlet.

4. The hydro-massage apparatus as recited in claim 1 further comprising a control mechanism for varying a flow rate of fluid from said pump to said first pulser mechanism.

5. The hydro-massage apparatus as recited in claim 4 wherein said first pulser mechanism repeatedly directs pulses of water to the first, second, third, fourth and fifth pairs of nozzles in that order.

6. The hydro-massage apparatus as recited in claim 1 further comprising:

a sensor that detects whether water in the tub reaches a given level;

a valve connected between said pump and said first pulser; and a controller connected to said sensor and said valve, to open said valve only when water in the tub reaches the given level.

7. The hydro-massage apparatus as recited in claim 1 further comprising a second plurality nozzles in the wall of said tub to direct a flow of water into the tub; and a second pulser mechanism coupled to receive water from said pump and having a pair of outlets each being connected to a different one of said second plurality of nozzles, said second pulser alternately directing a pulse of water through each outlet to thereby create a pulsating flow of water flow from the pair of nozzles.

8. The hydro-massage apparatus as recited in claim 7 further comprising a pillow covering said second plurality nozzles.

9. The hydro-massage apparatus as recited in claim 8 further comprising sensor that detects an absence of said pillow; and a controller responds to said detector by terminating water flow to said second plurality nozzles when said pillow is absent.

10. A hydro-massage apparatus comprising:

a tub having wall and a drain opening;

a pump with an inlet connected to the drain opening and having an outlet;

a nozzle assembly located in the wall of said tub to direct a flow of water into the tub;

a valve connecting the outlet of said pump to said nozzle assembly;

a pillow removeably attached over said nozzle assembly; and a control mechanism for detecting an absence of said pillow from said nozzle assembly and closing said valve in the absence of said pillow.

11. The hydro-massage apparatus as recited in claim 10 wherein said control mechanism includes a magnet attached to said pillow and a switch mounted in proximity to said nozzle assembly and being operated by the magnet, the switch providing a signal that causes said valve to be closed when said pillow is absent from eave the nozzle assembly.

12. The hydro-massage apparatus as recited in claim 10 further comprising a mechanism, coupled in series with said valve between said pump and said nozzle assembly, for pulsing water that flows through said nozzle assembly into the tub.

13. The hydro-massage apparatus as recited in claim 10 wherein said nozzle assembly has a plurality of nozzles; and further comprising a pulser mechanism coupled to receive water from said valve and having a plurality of outlets connected to the plurality of nozzles, said pulser mechanism directing a pulse of water sequentially through each one of the plurality of outlet to produce a jet of water sequentially at different ones of the plurality of nozzles and thereby creating a pulsating pattern of water flow that has a massaging effect in the tub.

14. The hydro-massage apparatus as recited in claim 13 further comprising a control connected to said valve and said pulser mechanism and being operable by a bather to regulate a rate at which pulses of water are directed through each nozzle.

15. A hydro-massage apparatus comprising:

a tub having a wall at one end and having a drain opening;

a pump having an inlet connected to the drain opening and having a pump outlet;

a first pulser mechanism having a inlet and a plurality of outlets, said first pulser directing a pulse of water sequentially through each one of the plurality of outlets;

a first valve coupling the pump outlet to the inlet of said first pulser mechanism;

a plurality of nozzles located in the wall of said tub to direct a flow of water against a back of a bather sitting in said tub, and each one of said plurality of nozzles being connected to a different one of the plurality of outlets of said first pulser mechanism;

a water outlet in the wall of said tub above the plurality nozzles;

a pillow covering said water outlet;

a second valve coupling the pump outlet to said water outlet;

a second pulser mechanism connected in series with said second valve between the pump outlet of said water outlet to pulsate water flowing therebetween;

a controller having a first mode of operation in which only the first valve is open so that water flows only through said plurality of nozzles, a second mode of operation in which only the second valve is open so that water flows only through said water outlet, and a third mode in which both the first and second valves are open so that water flows through said plurality of nozzles and said water outlet.

16. The hydro-massage apparatus as recited in claim 15 further comprising a control mechanism for varying a flow rate of fluid from said pump to said plurality nozzles and said water outlet.

17. The hydro-massage apparatus as recited in claim 16 further comprising sensor that detects an absence of said pillow; and wherein the controller responds to said detector by maintaining said second valve closed when said pillow is absent.

18. The hydro-massage apparatus as recited in claim 16 wherein said water outlet comprises first and second nozzles, and said second pulser mechanism sends pulses of water alternately through the first and second nozzles.

19. The hydro-massage apparatus as recited in claim 15 further comprising a sensor that detects whether water in said tub has reached a given level; and wherein said controller maintain said first valve closed when water in the tub does not reach the given level.

20. The hydro-massage apparatus as recited in claim 15 wherein said controller includes a mechanism for individually regulating the first and second pulser mechanisms to vary a rate at which each pulser mechanism pulsates water flow.

21. The hydro-massage apparatus as recited in claim 15 wherein said first and second pulser mechanisms each comprise:

a housing having a chamber, an inlet communicating with the chamber and coupled to said pump, and a outlet wall through which a plurality of outlets extend;

a valve plate within the chamber and abutting the outlet wall, and having an opening therethrough so that when said valve plate is rotated the opening sequentially opens and closes each of the plurality of outlets to a flow of water; and a device for rotating said valve plate.

* * * * *